US007377774B2

(12) United States Patent
Katsumata et al.

(10) Patent No.: US 7,377,774 B2
(45) Date of Patent: May 27, 2008

(54) CHANGE-OVER APPARATUS FOR COOLING GAS PASSAGES IN VACUUM HEAT TREATING FURNACE

(75) Inventors: Kazuhiko Katsumata, Tokyo (JP); Takuhiro Nakahara, Yamaguchi (JP)

(73) Assignee: IHI Corp., Tokyo (JP)

( * ) Notice: Subject to any disclaimer, the term of this patent is extended or adjusted under 35 U.S.C. 154(b) by 0 days.

(21) Appl. No.: 11/575,430

(22) PCT Filed: Sep. 16, 2004

(86) PCT No.: PCT/JP2004/013503

§ 371 (c)(1),
(2), (4) Date: Mar. 16, 2007

(87) PCT Pub. No.: WO2006/030504

PCT Pub. Date: Mar. 23, 2006

(65) Prior Publication Data

US 2007/0212657 A1 Sep. 13, 2007

(51) Int. Cl.
*F27D 15/02* (2006.01)

(52) U.S. Cl. ..... 432/77; 432/81

(58) Field of Classification Search ..... 432/77, 432/81, 176, 205, 242, 112, 113, 114; 373/109, 373/11, 112, 117, 118, 119, 120
See application file for complete search history.

(56) References Cited

U.S. PATENT DOCUMENTS 3,104,442 A * 9/1963 Cremer et al. ..... 432/77
4,836,776 A * 6/1989 Jomain ..... 432/176
6,821,114 B2 * 11/2004 Kisoda ..... 432/77
2007/0122761 A1 * 5/2007 Katsumata ..... 432/77

FOREIGN PATENT DOCUMENTS

| | | |
|---|---|---|
| DE | 3208574 A1 | 9/1983 |
| DE | 3215509 A1 | 10/1983 |
| DE | 3224971 A1 | 1/1984 |
| JP | 61-15079 | 1/1986 |
| JP | 05-001887 | 1/1993 |
| JP | 05-230528 | 9/1993 |
| JP | 11-153386 | 6/1999 |

OTHER PUBLICATIONS

Supplementary European Search Report issued in corresponding application No. EP 04 77 3162, completed Nov. 29, 2007 and mailed Dec. 6, 2007.
Yamazaki, Katsuhiro, "Vacuum Heat Treatment," vol. 30 No. 2, pp. 110-115, Apr. 1990.
International Search Report issued in corresponding application No. PCT/JP2004/013503, completed Dec. 14, 2004 and mailed Dec. 28, 2004.

* cited by examiner

*Primary Examiner*—Kenneth Bomberg
*Assistant Examiner*—Andrew M Juettner
(74) *Attorney, Agent, or Firm*—Griffin & Szipl, P.C.

(57) ABSTRACT

A change-over apparatus for cooling a gas passage is provided with a cooling chamber and a gas cooling and circulating system. The apparatus is further provided with a stationary partition plate and a slidable shield plate. The stationary partition plate has a suction opening and a discharge opening which are independently communicated respectively with a suction port and a discharge port, and the slidable shield plate has a shield part for partially shielding the suction opening and the discharge opening, whereby it is possible to alternately change over the direction of the gas passing through the cooling chamber.

6 Claims, 5 Drawing Sheets

CHANGE-OVER APPARATUS FOR COOLING GAS PASSAGES IN VACUUM HEAT TREATING FURNACE

This is National Phase Application in the United States of International Patent Application No. PCT/JP2004/013503 Sep. 16, 2004, the entire disclosure of which is incorporated herein by reference.

BACKGROUND OF THE INVENTION

1. Technical Field of the Invention

The present invention relates to a change-over apparatus for changing over cooling gas passages in a vacuum heat treating furnace.

2. Description of the Related Art

A vacuum heat treating furnace is the one in which inert gas or the like is refilled after depressurization of the inside thereof, in order to heat-treat an article to be treated. Since the vacuum heat treating furnace may completely remove moisture or the like sticking to the interior of the furnace and to the treated article after heating, by depressurizing again the furnace after evaporation of the moisture or the like, and by refilling the inert gas or the like thereinto, there may be exhibited such an merit that heat-treatment may be made without coloring by moisture (it is referred to as the "bright heat-treatment").

A gas-cooled vacuum heat treating furnace can exhibit several advantages as set forth in the following. Namely, (1) bright heat treatment can be achieved; (2) no occurrence of decarbonization and carburization; (3) occurrence of less deformation; and (4) an acquirement of a satisfactory working environment. However, early gas cooled vacuum heat treating furnaces were of depressurized cooling type, and accordingly, they offered such a disadvantage that its cooling rate cannot be sufficiently high. Thus, there has been materialized rapid circulating gas cooling type furnaces in order to aim at increasing the cooling rate.

Referring to FIG. 1, which is a view illustrating a configuration of a rapid circulating gas cooling type furnace disclosed in non-patent publication 1, i.e., "Vacuum Heat Treatment for Metals (2)" written by Katsuhiro Yamazaki, Heat Treatment Vol. 30-2, April, 1990. In the figure, there are shown a heat-insulator 50, a heater 51, an effective working zone 52, a furnace body 53 with a water cooling jacket, a heat-exchanger 54, a turbofan 55, a fan motor 56, a cooling door 57, a hearth 58, a gas distributor 59, and a damper 60 for changing over cooling gas passages.

Further, patent publication 1, i.e., Japanese Patent Laid-Open Publication No. H5-230528 discloses a method of promoting gas circulation and cooling in a vacuum furnace, as shown in FIG. 2, which comprises a heating chamber 66 provided in a gas tight vacuum container 61 and surrounded by a heat insulation wall 67, an article 64 to be heated being heated in a vacuum atmosphere by a heater 72 disposed in the heating chamber, and a cooler 62 and a fan 63 provided in the gas-tight vacuum container 61, for cooling unoxidizable gas through the cooler 62 and circulating the unoxidizable gas in the heating chamber 66 by the fan 63 through openings 68, 69 formed in the surface of the insulation wall 67 in order to forcibly cool the article 64 to be heated with the circulation gas, wherein a heat-resistant cylindrical hood 65 flared at least its one end is arranged so as to surround the article 64 arranged in the heating chamber 66, while keeping an appropriate distance therebetween, and so as to permit its both ends to be opposed respectively to the openings 68, 69 to thereby urge the unoxidizable gas to circulate in the heating chamber 66. It is noted that in this drawing figure, a damper 70 is provided for changing over cooling gas passages.

As stated above, in the case of adopting a high speed circulation gas cooling type in order to have the benefit of several advantages exhibited by a gas cooling type vacuum heat treating furnace and to enhance the cooling rate, it is extremely important to change over gas passages from the viewpoint of equalizing cooling rates of articles to be treated during cooling thereof.

Thus, in the furnace of high speed circulation gas cooling type as disclosed in the above-mentioned documents, there have been usually employed upper and lower damper units as a mechanism for changing over between upward and downward gas passages. However, in the case of the change-over mechanism employing the upward and downward gas passage, there have been arising problems as indicated below:

(1) Since the damper unit causes large variation in load depending upon its open and close positions, due to a wind pressure of gas which passes through these positions at a high speed, and accordingly, it is difficult to smoothly actuate such a damper unit under affection by the wind pressure in the case of a high pressure gas;

(2) Since the damper unit has such a configuration that an angle from its opening position to its closing position is not in proportion to its opening area, balancing between opening areas is difficult to obtain at the stage of changing over of a plurality of upper and lower drives so that a difference occurs between opening areas of a suction port and a discharge port, or the difference becomes large, and accordingly, the volume of cooling gas varies, resulting in making it difficult to stabilize gas cooling;

(3) Since there exist a plurality of upper and lower dampers, a plurality of drives is necessarily required, and accordingly, the structure of the mechanism becomes complicated; and (4) Since the opening areas are delimited by the upper and lower dampers, the opening areas are smaller in comparison with the inner surface of the body of the furnace.

SUMMARY OF THE INVENTION

The present invention is contrived to solve the above-mentioned problems and thus, an object of the present invention is to provide a cooling gas passage change-over apparatus for a vacuum heat treating furnace, which is subjected to less affection by a wind pressure so as to smoothly change over gas passages, which causes less variation in opening area and less difference in opening area between a suction port and a discharge port so as to carry out stable gas cooling, which has a simple structure with a single drive for changing over gas passages while a large opening area can be ensured.

According to the present invention, there is provided a change-over apparatus for changing over cooling gas passages in a vacuum heat treating furnace, which is provided with a cooling chamber surrounding a cooling zone in which an article to be treated is statically set, and a gas cooling and circulating system for cooling and circulating a gas passing through the cooling chamber, for cooling the heated article to be treated with the circulation gas under pressure, wherein the change-over apparatus comprises: a stationary partition plate configured to partition between the cooling chamber and the gas cooling and circulating system, and a slidable shield plate slidably driven along an outer surface of the stationary partition plate, the stationary partition plate having a suction opening and a discharge opening which are independently communicated respectively with a suction port and a discharge port of the gas cooling and circulating system, the slidable shield plate having a shield part for partially shielding the suction opening and the discharge opening of the stationary partition plate, to thereby alternately change over the direction of gas passing through the cooling chamber is.

With the above-described configuration of the present invention, the direction of gas passing through the cooling chamber can be alternately changed over only by sliding the slidable shield plate along the stationary partition plate partitioning between the cooling chamber and the gas cooling and circulating system.

Further, the slidable shield plate is slidably driven to vertically move in respect to the flowing direction of the gas, and accordingly, even if a gas under a high pressure (a gas having a high density) is employed, affection by a wind pressure thereof can be lessened, thereby enabling it to smoothly change over the gas passages.

Further, since the stationary partition plate has the suction opening and the discharge opening which are arranged to be independently communicated with the suction port and the discharge port of the gas cooling and circulating system, respectively, and since the slidable shield plate has the shield part which is arranged for partially shielding the suction opening and the discharge opening of the stationary partition plate, respectively, there is no likelihood that a variation in an opening area and a difference in an opening area between the suction port and the discharge port can occur, thereby enabling it to carry out a stable gas cooling operation. Further, the structure thereof is simple, which permits a single drive to drive changing over of the direction of gas passage, so that a large opening area can be surely acquired.

According to a preferred embodiment of the present invention, the cooling chamber has a gas passage passing therethrough in a vertical direction, and thus, when the gas flows downward in the cooling chamber, the suction opening communicates only with the lower part of the cooling chamber while the discharge opening communicates with only the upper part of the cooling chamber, and further, when the gas flows upward in the cooling chamber, the suction opening communicates with only the upper part of the cooling chamber while the discharge opening communicates with only the lower part of the cooling chamber.

With this configuration, an internal area "A" of the furnace body partitioning between the cooling chamber and the gas cooling and circulating system is allocated to the suction port and the discharge port of the gas cooling and circulating system by halves, respectively, and the area of each of the suction port and the discharge port is allocated to its upper and lower part by halves thereof, respectively, so as to set the area of each of the suction opening and the discharge opening to about one-fourth of the inner surface "A" of the furnace body. Accordingly, the area of the gas passage can be set to be larger in comparison with the conventional one. Therefore, the flow rate of the passing gas can be reduced, so that it may be possible to reduce pressure loss.

The above-mentioned stationary partition plate has one and the other pairs of suction opening and discharge opening, which are arranged vertically, and, preferably, the shield part of the slidable shield plate are arranged to shield the upper suction opening and the lower discharge opening, simultaneously, and then slides so as to shield the lower suction opening and the upper discharge opening, simultaneously.

With this configuration, by merely sliding the slidable shield plate up and down, the suction openings and the discharge openings in the vertically arranged one and the other pairs can be changed over so that the direction of the gas passing through the cooling chamber may be changed over in an alternate manner.

The cooling chamber is positioned so as to allow an article to be treated to be directly transported thereinto from the outside and to be directly transported therefrom toward the outside by wary of an delivery door, and the gas cooling and circulating system is located at a side where it does not affect the introduction and delivery of the article to be treated.

With this configuration, it is possible to transport the article to be treated directly into the cooling chamber from the outside by way of the delivery door and to transport the same therefrom toward the outside with no affection by the gas cooling and circulating system The above-mentioned gas cooling and circulating system is comprised of a cooling fan arranged adjacent to the cooling chamber to suck and pressurize a gas which has passed through the cooling chamber, and an upper and a lower heat-exchangers which are arranged between the stationary partition plate and the cooling chamber to indirectly cool a gas passing therethrough.

With this configuration, even though the direction of the gas passing through the cooling chamber can be alternately changed over, the gas flowing out and into the cooling chamber can be efficiently cooled by the upper and lower heat-exchangers.

Alternatively, the above-mentioned gas cooling and circulating system may be comprised of a cooling fan arranged adjacent to the cooling chamber, to suck and cool a gas which has passed through the cooling chamber, and a heat-exchanger arranged between a discharge port of the cooling fan and the stationary partition plate to indirectly cool the gas discharged from the cooling fan.

With this configuration, between the stationary partition plate and the cooling fan, the overall inner surface is communicated with the suction port of the cooling fan while the overall outer surface is communicated with the discharge port of the cooling fan, and accordingly, by setting a sufficient extent of gap for respective of the discharge port and the suction port, the gas can go around to the opposite sides even though the inner and outer surfaces are opened by only a half, respectively, so that it is able to achieve effective use of the heat-exchanger in its entirety.

The other objects and advantageous features of the present invention will be apparent from the following description with reference to the accompanying drawings.

DESCRIPTION OF THE PREFERRED EMBODIMENTS

Figure 1:
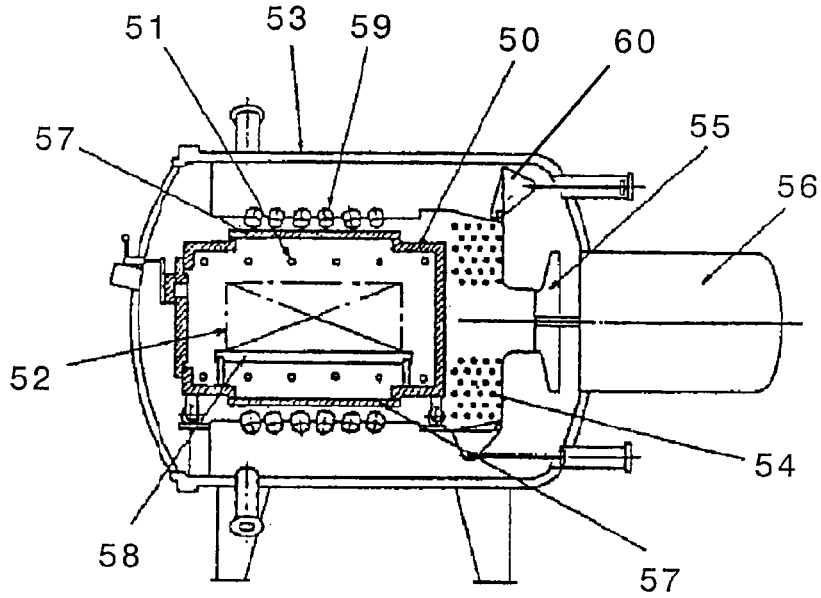
Fig.1 prior art
FIG. 1 is a view illustrating a configuration of a high speed circulation gas cooling furnace disclosed in the non-patent publication 1, i.e., Heat Treatment Vol. 30-2 as mentioned above.
Figure 2:
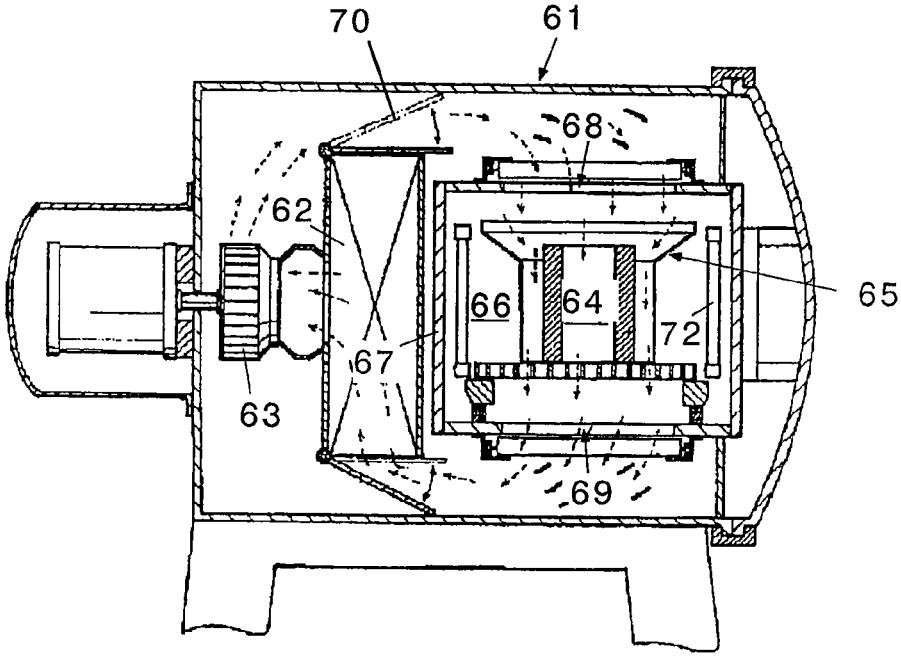
Fig.2 prior art
FIG. 2 is a view illustrating a configuration in the "A method of promoting gas circulation and cooling in a vacuum furnace" disclosed in the patent publication 1, i.e., Japanese Patent Laid-Open publication No. H5-230528.

A description of a preferred embodiment of the present invention will be provided hereinbelow, with reference to the accompanying drawings. Like reference numerals are used to denote like parts throughout the drawings in order to omit duplication of explanation thereto.

Figure 3:
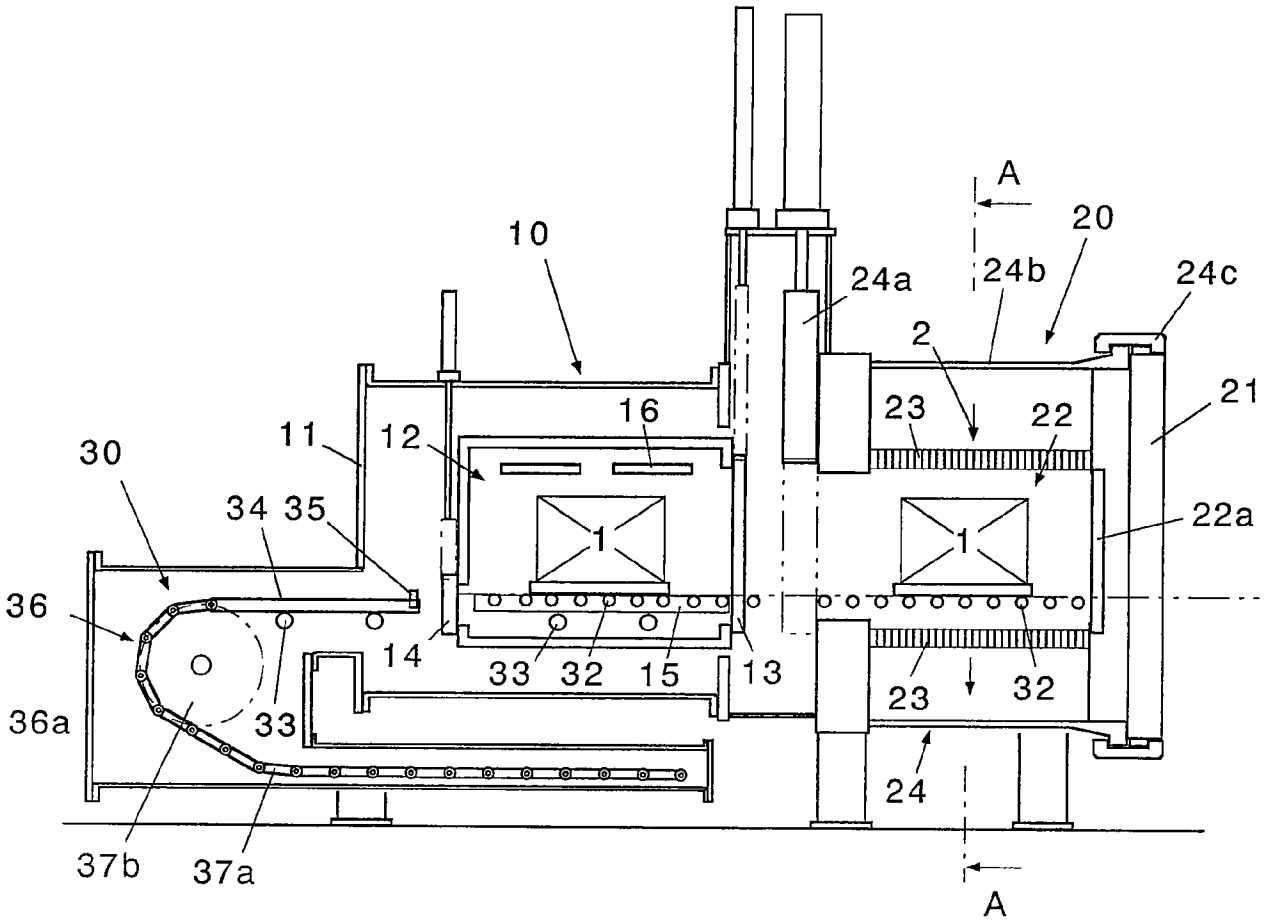
FIG. 3 is a view illustrating an overall configuration of a vacuum heat treating furnace provided therein with a change-over apparatus for cooling gas passages according to the present invention.

Referring to FIG. 3, which shows an overall configuration of a vacuum heat treating furnace provided therein with a change-over apparatus for cooling gas passages, according to the present invention, the vacuum heat treating furnace is a multiple chamber type heat treating furnace which is comprised of a vacuum heating furnace 10, a gas cooling furnace 20 and a shifting unit 30.

The vacuum heating furnace 10 is a sealable furnace arranged adjacent to a cooling chamber 22 in the gas cooling furnace 20 with a height which is equal to the cooling chamber 22, and incorporating a heating chamber 12 therein which heats an article 1 to be treated. The vacuum heating furnace 10 has a function capable of recharging and heating inert gas or the like after depressurization of the article 1 to be treated.

The gas cooling furnace 20 is sealable pressurizing vessel incorporating therein the cooling chamber 22 applying gas cooling to the article 1 to be treated after being heated. Namely, the gas cooling furnace 20 has a function capable of cooling the article to be treated after being heated by means of a pressurized circulating gas 2.

The shifting unit 30 has a function capable of horizontally shifting the article 1 to be treated between the heating chamber 12 and the cooling chamber 22.

The vacuum heating furnace 10 is comprised of a vacuum container 11 adapted to be vacuumed in its inside, the heating chamber 12 for accommodating therein the article 1 to be treated, a front door 13 through which the article 1 to be treated is conveyed into and out of the heating chamber, a rear door 14 for closing an opening through which the article 1 to be treated is shifted from the heating chamber, a carrier bed 15 for mounting thereon the article 1 to be treated, in a manner such that the article 1 is horizontally moved back and forth, a heater 16 capable of heating the article 1 to be treated, and the like.

With this configuration, the vacuum container 11 can be depressurized so as to effect a vacuum condition in its inside, and then the article 1 to be treated can be heated up to a predetermined temperature by the heater 16.

The gas cooling furnace 20 is comprised of a delivery door 21, the cooling chamber 22, rectifiers 23 and a vacuum container 24.

The cooling chamber 22 is positioned so as to enable it to directly transport therein the article 1 to be treated, from the outside and also transport therefrom the article 1 to be treated, toward the outside through the delivery door 21, that is, the article 1 to be treated can be directly carried into the cooling chamber 22 from the outside and also carried out from the cooling chamber 22 to the outside, through the delivery door 21, with neither adverse affection nor any interference by the gas cooling and circulating system which will be described later.

In this embodiment, the delivery door 21 is provided on the side remote from the heating chamber 12 (on the right side in the figure), and is used for direct carrying-in and delivery of the article 1 to be treated into and from the cooling chamber 22. The carrying-in and the delivering of the article 1 to be treated are performed by a shifting means (for example, a stationary loader/unloader unit, a forklift unit, a crane unit or the like) provided outside the furnace. It is noted that the figure shows the delivery door 21 at its closed condition.

The cooling chamber surrounds a cooling zone where the article 1 to be treated is stationarily loaded, and is formed therein a gas passage having a constant section in a vertical direction. The cooling chamber 22 can be opened and closed by an opening door 22*a* on the delivery door side. It is noted that the delivery door 21 may be substituted for the opening door 22*a* in a certain case.

The straightener units 23 are arranged in the upper and lower parts of the cooling chamber 22 so as to cover the upper and lower ends of the latter, having a function capable of straightening a vertical stream in order to equalize the velocity distribution in the flow of the gas passing through the cooling chamber 22.

The vacuum container 24 is comprised of an intermediate heat insulation door 24*a* arranged to face the front door 13 of the vacuum heating furnace 10, a cylindrical container barrel 24*b* for accommodating therein the article 1 to be treated, and a clutch ring 24*c* for opening and closing the delivery door 21 in a gas tight manner with respect to the container barrel 24*b*.

With this configuration, when the clutch ring 24*c* is released so as to open the delivery door 21, the article 1 to be treated can be directly received and accommodated therein. Further, the delivery door 21 is connected to the container barrel 24*b* in a gas tight manner by means of the clutch ring 24*c*, and a pressurized gas (argon, helium, nitrogen or the like) is fed thereinto through a pipe line which is not shown, so that a pressurized gas may be used for cooling.

The shifting unit 30 is comprised of a plurality of free rollers 32, a push/pull member 34 and a drive unit 36.

The plurality of free rollers 32 are arranged in both the heating chamber 12 and the cooling chamber 22, and horizontally movably support the article 1 to be treated only at widthwise opposite ends of the article 1. Each of these free rollers 32 is a cylindrical short roller which is freely rotatable around its center axis, and is adapted to substantially prevent smooth flow of the gas in the cooling chamber 22 from being hindered. Further, the free rollers 32 only has such a function that the article 1 to be treated is supported so as to be movable in the horizontal direction, each having a simple bearing (for example, a journal bearing having a large internal gap) which can prevent the function of the free rollers from being hindered even though these rollers are heated within the heating chamber 12. Thus, they have such a structure which does not substantially require a countermeasure against thermal problems, if periodical maintenance inspection and/or replacement are carried out.

The push/pull member 34 is horizontally shifted while keeping an engagement with the article 1 to be treated, and accordingly, pushes and pulls the article 1 to be treated, horizontally. Further, the push/pull member 34 has, at its front end part, an engaging member 35 capable of performing rising-up or lying-down motion which is carried out at any time by an actuator which is incorporated in the rear end part (the left end part) of the push/pull member 34 and which is not shown. Through this rising-up or lying-down motion, the engaging member 35 can be changed at any time between a standing position thereof and a lying position thereof, and can be engaged with the article 1 to be treated (or its carrier bed) so as to push and pull the article to be treated in a horizontal direction at the standing position while it can be moved in a horizontal direction without being engaged with the article to be treated (or its carrier bed) at the lower lying position.

It is noted that the above-mentioned rising-up and lying-down mechanism should not be limited to a mechanism which carry out the rising-up and lying-down motion with the use of the actuator, but any one of other mechanisms such as a rack-and-pinion mechanism, a chain drive mechanism and the like may be used if it can rise up or lie down outside the heating chamber 12 and the cooling chamber 22.

The drive unit 36 is arranged adjacent to the hearing chamber on the side remote from the cooling chamber 22 (on the left side in the drawing figure), and has a function capable of horizontally moving the push/pull member 34.

In this embodiment, the shifting unit 30 is of a chain pusher type, and further, the drive unit 36 is comprised of a horizontally movable chain 37*a* coupled with the rear end part of the push/pull member 34 which is therefore horizontally moved, a sprocket 37*b* meshed with the horizontally movable chain, and a rotating motor (which is not shown) for rotating the sprocket 37*b*. Further, free rollers 33 for the push-pull member are arranged in a suitable zone other than the cooling chamber 22, so that the push/pull member 34 and the horizontally movable chain 37*a* are always held at the horizontal state thereof.

With this configuration, the sprocket 37*b* is rotated by the rotating motor so as to horizontally move the horizontally movable chain 37*a* for horizontally moving the push/pull member 34, and accordingly, the engaging member 35 at the front end part thereof can be moved horizontally.

With the described configuration, only the free rollers 32 constituting the shifting unit 30 are arranged in the heating chamber 12 and the cooling chamber 22, and accordingly, they supports the article 1 to be treated, only at the widthwise opposite ends of the article 1 to be treated. Thus, they do not substantially hinder smooth flow of the gas in the cooling chamber 22.

Further, the free rollers 32 have only a function capable of supporting the article 1 to be treated in a horizontal shifting direction, and accordingly, substantially no countermeasure against thermal problems is required so as to have a simple structure.

Accordingly, since no shifting mechanism other than the free rollers 32 is present in the cooling chamber, the flow of the gas is not hindered, and since the no shifting mechanism other than the free rollers is present also in the heating chamber, no complicated shifting measure is required.

Further, when the engaging member 35 is brought to the standing position in order to move the push/pull member 34, the article 1 to be treated can be horizontally pushed and pulled, and further, when the engaging member 35 is moved back to the lying-down position, the push/pull member 34 can be horizontally pushed and pulled without being engaged with the article 1 to be treated. Thus, after the article 1 to be treated is once loaded into the cooling chamber 22 from the outside, it can be shifted from the cooling chamber 22 into the heating chamber 12 while after the heating treatment, the article 1 to be treated can be shifted back from the heating chamber 12 to the cooling chamber 22, with the use of the shifting unit 30, and after the cooling, it can be transported therefrom toward the outside. Further, during heating in the heating furnace 12 and during cooling in the cooling chamber 22, the push/pull member 34 can be pulled back for standby to a position on the left side of the heating chamber 12 and therefore, the respective chambers can be maintained at their air-tight condition. Further, during the standby, the shifting unit 30 other than the free rollers 32 is located in the no heating zone, and accordingly, it can be prevented from being overheated, without using a specific countermeasure against thermal problems.

Figure 4:
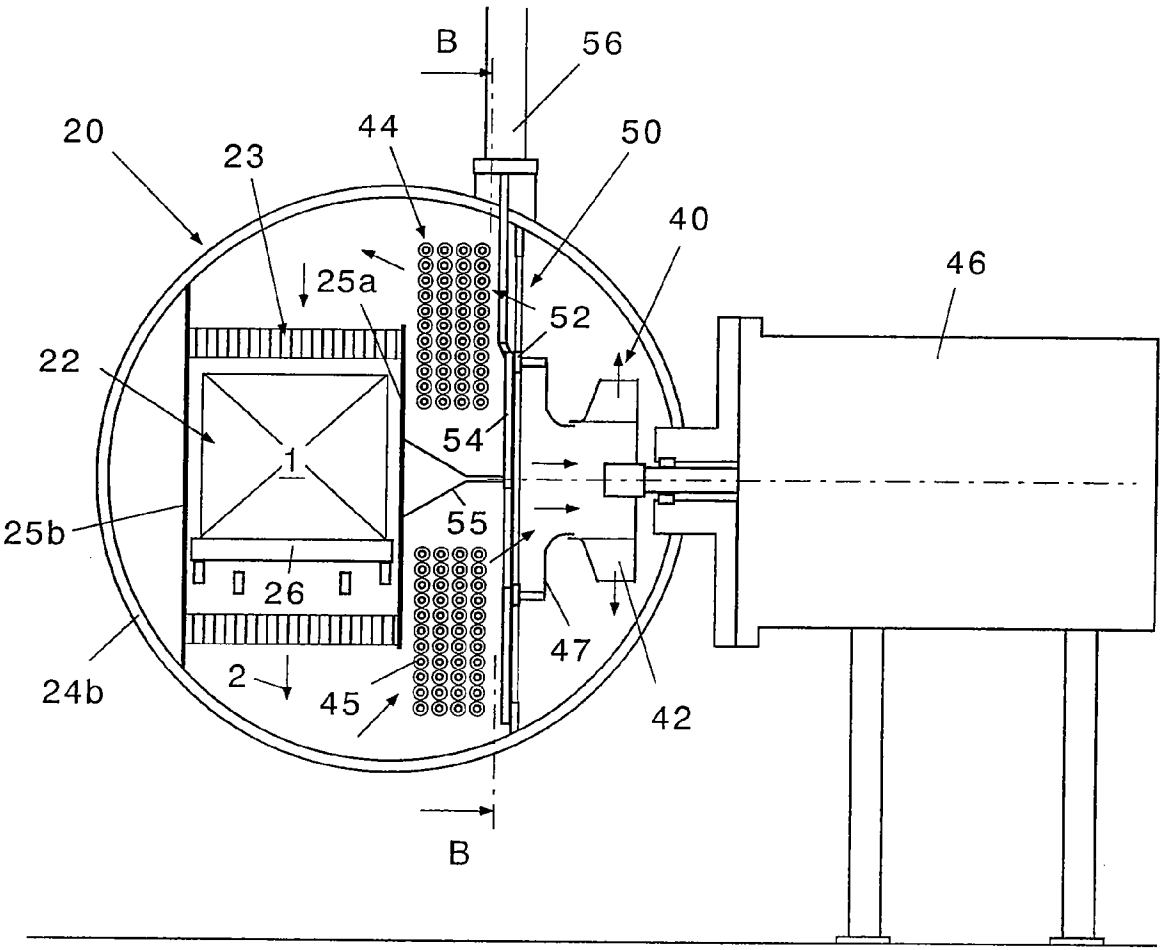
FIG. 4 is a cross-sectional view, taken along the line A-A in FIG. 3.

Referring to FIG. 4 which is a cross-sectional view, taken along the line A-A in FIG. 3, the gas cooling furnace 20 further comprises a gas cooling and circulating system 40 and a change-over apparatus 50 for cooling gas passages.

The cooling chamber 22 is provided in the container barrel 24*b*, adjacent to the vacuum heating furnace 10, at a position substantially on the left side as viewed in this drawing figure. Further, the cooling chamber 22 is partitioned by the intermediate straightener plate 25*a* on the gas cooling and circulating system side (the right side in the drawing figure) and by a vertical straightener 25*b* on the side remote therefrom (the left side in the drawing figure), and accordingly, the gas passage having a substantially uniform section in a vertical direction is formed in the cooling chamber 22.

The cooling zone is located in the cooling chamber 22, and the article 1 to be treated, which is a small-sized metal component such as a turbine blade, a stator vane or bolts and the like for use in a jet engine, is accommodated in a tray or a basket which is set on a carrier bed 26 that is gas permeable, at the center of the cooling chamber 22.

A carrier bed 26 is set at the same level with the carrier bed 15 in the vacuum heating furnace 10, and is freely moved on rollers incorporated therein.

The gas cooling and circulating system 40 is mounted at the side surface of the barrel 24*b* of the container 24 in a direction orthogonal to the direction in which the article 1 to be treated is carried in and out, so as to prevent the carry-in and carry-out of the article 1 to be treated from being directly affected thereby.

Referring to this drawing figure, the gas cooling and circulating system 40 is comprised of a cooling fan 42 located in the barrel of the container 24 adjacent to the cooling chamber 22, for sucking and pressurizing the gas having passed through the cooling chamber 22, and upper and lower heat-exchangers 44, 45 located between a stationary partition plate 52 (which will be explained later) and the cooling chamber 22, for indirectly cooling the gas passing therethrough.

The cooling fan 42 is rotatively driven by a cooling fan motor 46 attached to the cylindrical container barrel 24*b*, and is structured so that gas is sucked from its center part thereof and is discharged from the outer peripheral part thereof. The heat-exchangers 44, 45 are formed of, for example, cooling fin tubes the interior of which is water-cooled.

Further, a hollow cylindrical partition duct 47 is provided for partitioning between the center part (the suction side) and the outer peripheral part (the discharge part) of the cooling fan 42, and the inside thereof is communicated with suction openings 52*a* of the later-described stationary partition plate 52 while the outside thereof is communicated with the discharge opening 52*b* of the same stationary partition plate.

With this configuration, even though the direction of the gas 2 passing through the cooling chamber 22 is alternately changed over in a vertical direction, the gas flowing out from and into the cooling chamber can be efficiently cooled by the upper and lower heat-exchanger 44, 45.

It is noted that there may be employed another configuration different from the above-mentioned configuration, such that a heat-exchanger is arranged between the discharge port (outside) of the cooling fan 42 and the stationary partition plate 52, and accordingly, the gas discharged from the cooling fan 42 may be indirectly cooled by the heat-exchanger.

With the above-mentioned configuration, between the stationary partition plate 52 and the cooling fan 42, the entire interior surface of the stationary partition plate is communicated with the suction port of the cooling fan 42 via a gap while the entire exterior surface of the same stationary partition plate is communicated with the discharge port of the cooling fan 42 via a gap, and accordingly, if a sufficient extent of gag is obtained. With respect to the discharge port and the suction port, and even though only haves of the interior and exterior surfaces are opened, the gas is permitted to go around to the opposite surfaces via the gaps, whereby it is possible to effectively use the heat-exchanger in its entirety.

Referring to FIG. 4, the change-over apparatus 50 for a cooling gas passage is comprised of the stationary partition plate 52, a slidable shield plate 54 and a slide drive unit 56.

The stationary partition plate 52 and the slidable shield plate 54 vertically partition between the cooling chamber 22 and the gas cooling and circulating system 40 so as to partially block therebetween. The slide shield plate 54 is vertically and slidably driven by the slide drive unit 56 so as to slide along the outer surface of the stationary partition plate 52. Further, a lubricative element or material (for example, a bearing, lead brass material or graphite material) which is not shown is laid between the stationary partition plate 52 and the slidable shield plate 54, being attached to at least one of them so as to reduce any gas leakage therebetween as well as to reduce a slide resistance therebetween to promote a smooth motion of the slidable shield plate 54.

The slide drive unit 56 is in this example, a pneumatic or hydraulic cylinder. However, the present invention should not be limited to this configuration, but any other well-known drive unit (e.g., a rack-and-pinion drive mechanism) may be used.

Further, in this figure, a center partition plate 55 which vertically partitions between the stationary partition plate 52 and the cooling chamber 22 is provided with its opposite ends being respectively fixed to the center part of the stationary partitioning plate 52 and the intermediary straightener plate 25*a* of the cooling chamber 22.

Figure 5:
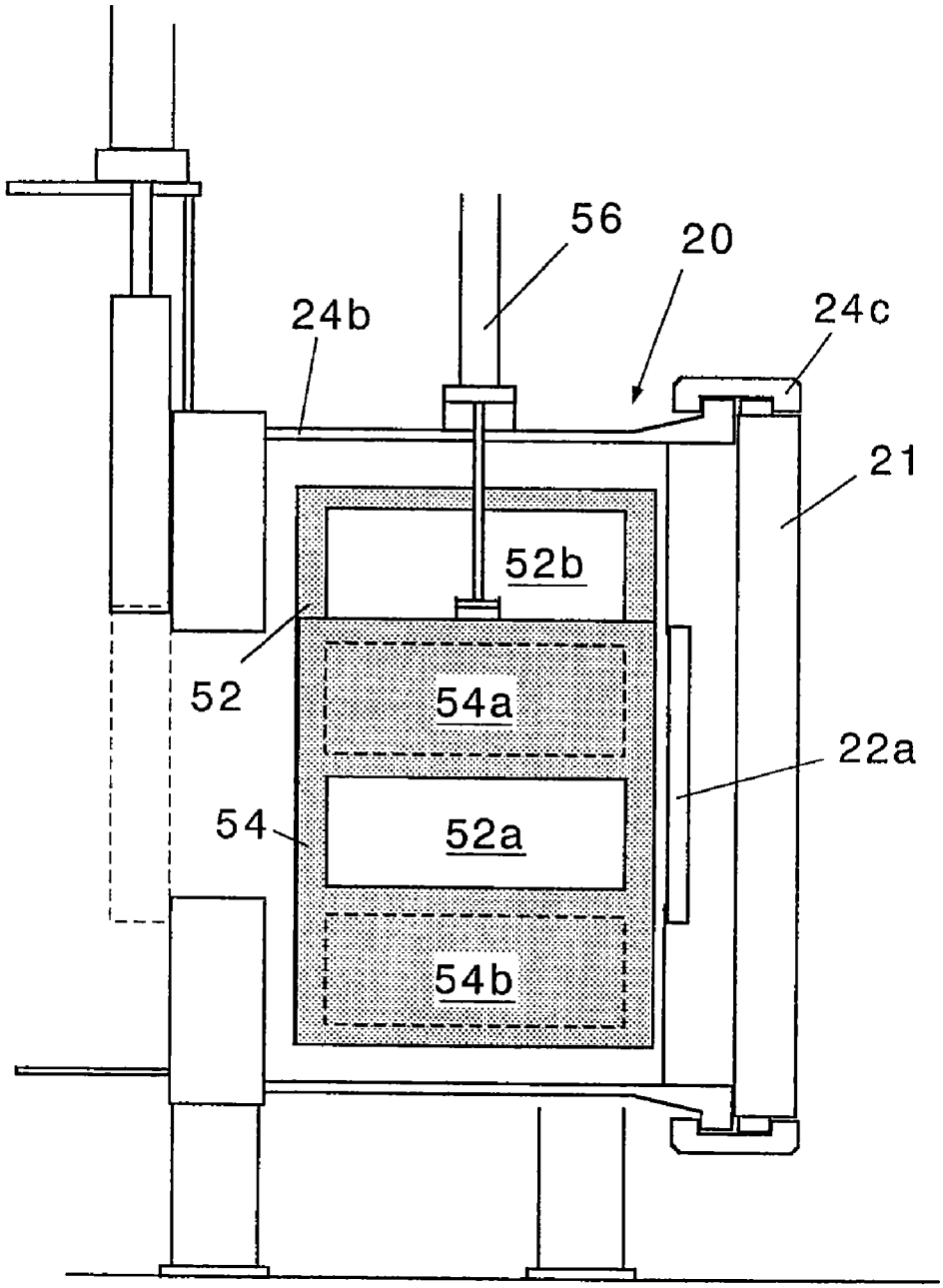
FIG. 5 is a cross-sectional view, taken along the line B-B in FIG. 4.
Figure 6A:
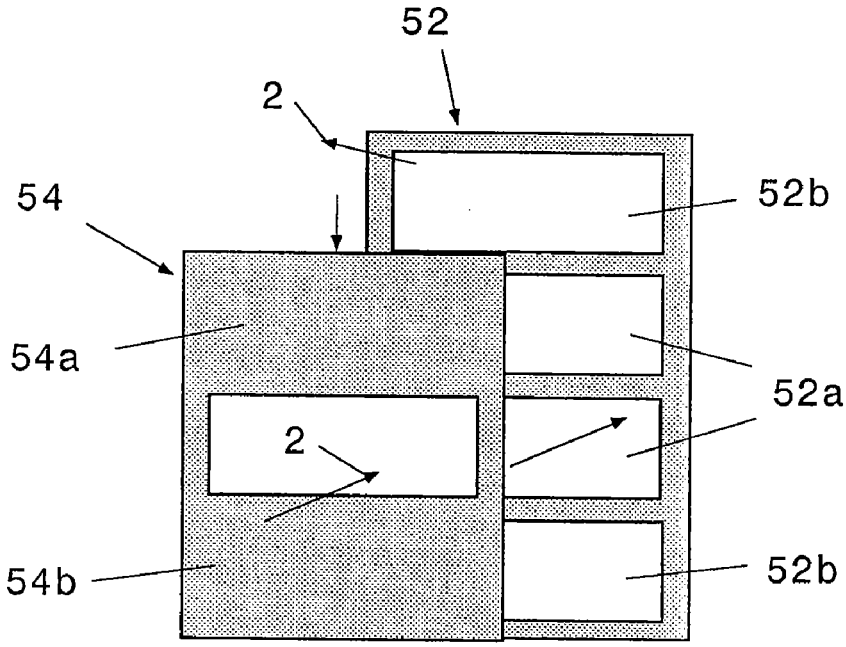
FIGS. 6A and 6B are views for explaining the operation of the present invention.
Figure 6B:
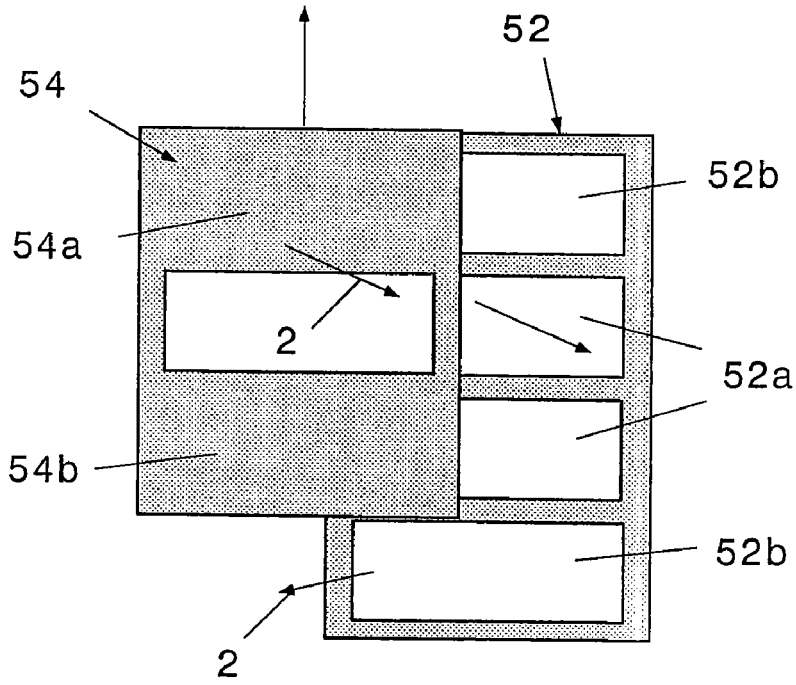

FIG. 5 is a cross-sectional view, taken along the line B-B in FIG. 4, and FIGS. 6A and 6B are views for explaining the operation of the present invention, in which the stationary partition plate 52 and the slidable shield plate 54 are separately shown so that the slidable shield plate 54 is located at a lower position in FIG. 6A while the plate 54 is located in an upper position in FIG. 6B.

As shown in FIGS. 6A and 6B, the stationary partition plate 52 has suction openings 52*a* and discharge openings 52*b* in upper and lower pairs, which are independently communicated respectively with the suction port and the discharge port of the gas cooling and circulating system. It is preferable that the sizes of the openings are substantially equal to each other. Further, the outer periphery of the stationary partition plate 52 is fixedly secured to the cylindrical container barrel 24*b* in a gas tight manner as shown in FIG. 5.

Meanwhile, the slidable shield plate 54 has shield parts 54*a*, 54*b* which are adapted to partially shield the suction openings 52*a* and the discharge openings 52 of the stationary partition plate. Referring to FIG. 6A in which the slidable shield plate 54 is located at the lower position, the shield parts 54*a*, 54*b* shield the upper suction opening 52*a* and the lower discharge opening 54*b* of the stationary partition plate 52 at the same time. Further, referring to FIG. 6B in which it is located at the upper position, the shield parts 54*a*, 54*b* have been slid so as to shield the lower suction opening 52*a* and the upper discharge opening 52*b* at the same time.

With this configuration, as shown in FIG. 5, by merely sliding the slidable shield plate 52 up and down, the suction openings 52*a* and the discharge openings 52*b* in upper and lower pairs are changed over so as to alternately change over the direction of the gas passing through the cooling chamber 22.

Referring to FIGS. 4, 5 and 6A which show such a condition that the slidable shield plate 52 has been slid to the lower position, the gas 2 having passed downward though the cooling chamber, is cooled in the lower heat-exchanger 45 in this case, and then passes through the lower suction opening 52*a* so as to be sucked into the center part (suction side) of the cooling fan 42. Further, the gas discharged from the outer peripheral part (discharge side) of the cooling fan 42 passes through the upper discharge opening 52*b* so as to be cooled in the upper heat-exchanger 44, and then passes downward through the cooling chamber. The gas is thus circulated.

Referring to FIG. 6B which shows such a condition that the slidable shield plate 52 has been slid to the upper position, the gas 2 having passed upward through the cooling chamber is cooled in the upper heat-exchanger 44 in this case, and then passes through the upper suction opening 52*a* so as to be sucked into the center part (the suction side) of the cooling fan 42. Further, the gas 2 discharged from the outer peripheral part (the discharge side) of the cooling fan 42 passes through the lower discharge opening 52*b* so as to be cooled in the lower heat-exchanger 52*b*, and then flows upward through the cooling chamber 22. The gas is thus circulated.

With the configuration as stated above, by merely sliding the slidable shield plate 54 along the outer surface of the stationary partition plate 52 which partitions between the cooling chamber 22 and the gas cooling and circulating system 40, the direction of the gas passing through the cooling chamber 22 can be alternately changed over.

Further, since the slidable shield plate 54 is slidably driven in such a way that it is moved, perpendicular to the flowing direction (a horizontal direction in this case), substantially no affection by a wind pressure occurs even though a high pressure gas (high density gas) is used, so that it is possible to smoothly change over gas passages.

Further, since the stationary partition plate 52 has the suction openings 52*a* and the discharge openings 52*b* which are independently communicated with the suction port and the discharge port of the gas cooling and circulating system while the slidable shield plate 54 has the shield parts 54*a*, 54*b* which partially shield the suction openings and the discharge openings of the stationary partition plate, variation in opening area and a difference in opening area between the suction port and the discharge port can hardly occur, thereby it is possible to carry out stable gas cooling. Further, the configuration thereof is simple and can be changed over by a single drive unit, so that it is possible to ensure a large opening area.

It is noted that the present invention should not be limited to the above-mentioned embodiment, and accordingly, it goes without saying that the present invention may be varied and modified without departing the spirit and scope of the present invention. For example, although the explanation has been made of such a configuration that the heating chamber and the cooling chamber are separated from each other, the present invention should not be limited to this configuration, but the present invention may be applied to a single chamber furnace in which both heating and cooling can be carried out in a single chamber.

What is claimed is:

1. A change-over apparatus for a cooling gas passage in a vacuum heat treating furnace for cooling a heated article to be treated with a pressurized circulation gas, comprising a cooling chamber surrounding a cooling zone in which the article to be treated is stationarily placed, and a gas cooling and circulating system for cooling and circulating a gas passing through the cooling chamber, wherein the apparatus further comprises:

a stationary partition plate partitioning between the cooling chamber and the gas cooling and circulating system, and a slidable shield plate adapted to be slidably driven along an outer surface of the stationary partition plate, the stationary partition plate having a suction opening and a discharge opening which are independently communicated, respectively, with a suction port and a discharge port of the gas cooling and circulating system, the slidable shield plate having a shield part which partially shield the suction opening and the discharge opening of the stationary partition plate, to thereby alternately change over a direction of the gas passing through the cooling chamber.

2. The change-over apparatus for cooling gas passages as set forth in claim 1, wherein the cooling chamber has a gas passage through which the gas flows in a vertical direction, and the suction opening and discharge opening are arranged in a manner such that when the gas flows downward the suction opening is communicated with only the lower part of the cooling chamber and the discharge opening is communicated with only the upper part of the cooling chamber, but when the gas flows upward in the cooling chamber, the suction opening is communicated only with the upper part of the cooling chamber while the discharge opening is communicated only with the lower part of the cooling chamber.

3. The change-over apparatus as set forth in claim 1, wherein the stationary partition plate has paired suction and discharge openings arranged in an upper pair and a lower pair, the shield part of the slidable shield plate shields the upper suction opening and the lower discharge opening of the stationary partition plate at the same time, and is then slid so as to shield the lower suction opening and the upper discharge opening at the seam time.

4. The change-over apparatus for cooling gas passages as set forth in claim 1, wherein the cooling chamber is arranged in a manner such that the article to be treated is directly carried therein and is delivered therefrom through a delivery door, and the gas cooling and circulating system is arranged on a side where occurrence of any direct interference is prevented for carrying-in and delivery of the article to be treated.

5. The change-over apparatus as set forth in claim 1, wherein the gas cooling and circulating system comprises a cooling fan arranged adjacent to the cooling chamber to suck and pressure the gas having passed through the cooling chamber, and upper and lower heat-exchangers arranged between the stationary partition plate and the cooling chamber to indirectly cool the gas passing therethrough.

6. The change-over apparatus as set forth in claim 1, wherein the gas cooling and circulating system comprises a cooling fan arranged adjacent to the cooling chamber to suck and pressurize the gas having passed through the cooling chamber, and a heat-exchanger arranged between the discharge port of the cooling fan and the stationary partition plate to indirectly cool the gas discharged from the cooling fan.

* * * * *